US007568241B2

(12) United States Patent
Roberts

(10) Patent No.: US 7,568,241 B2
(45) Date of Patent: Aug. 4, 2009

(54) EMERGENCY PATIENT SUPPORT AND TRANSPORT SYSTEM

(76) Inventor: Thomas E. Roberts, 19880 Gunder Rd., Bristol, IN (US) 46507

( * ) Notice: Subject to any disclaimer, the term of this patent is extended or adjusted under 35 U.S.C. 154(b) by 110 days.

(21) Appl. No.: 11/537,192

(22) Filed: Sep. 29, 2006

(65) Prior Publication Data

US 2007/0220672 A1 Sep. 27, 2007

Related U.S. Application Data

(60) Provisional application No. 60/721,838, filed on Sep. 29, 2005.

(51) Int. Cl.
*A61G 7/10* (2006.01)

(52) U.S. Cl. ..... 5/81.1 R; 5/620

(58) Field of Classification Search ..... 5/81.1 R–86.1, 5/600, 620

See application file for complete search history.

(56) References Cited

U.S. PATENT DOCUMENTS

| | | | | |
|---|---|---|---|---|
| 4,222,132 | A | 9/1980 | Crim et al. | |
| 6,842,923 | B1 * | 1/2005 | Castellani et al. | 5/627 |
| 2005/0028283 | A1 | 2/2005 | Castellani et al. | |

* cited by examiner

*Primary Examiner*—Alexander Grosz
(74) *Attorney, Agent, or Firm*—Howard B. Rockman

(57) ABSTRACT

An emergency patient support and transport apparatus that is designed to be used in emergency response situations to treat patients that have been exposed to hazardous biological, chemical or radioactive materials. The patient support and transport apparatus is in the form of a rail system that allows a patient and the patient's support bed to be transported across the rails to a medical treatment zone, such as a decontamination zone, where decontamination of the patient and support bed occurs. The support and transport apparatus is formed of a patient support track formed of individual track sections that are collapsible for ease of transport and storage. The individual track sections are adapted to be interconnected to form at least two continuous rail surfaces. The patient support track is used in combination with a patient gurney having a base portion and a removable stretcher portion for supporting the patient. The stretcher portion of the patient gurney is adapted to be releasably secured to the base portion. The base portion of the patient gurney includes a pair of support rails that can be connected to either the first or second end of the continuous rails of the patient support track. The stretcher portion of the patient gurney includes a plurality of rollers and guides that permits the stretcher to roll from the support rails of the base portion to the two continuous rails of the patient support track. This allows the patient and the stretcher portion to be treated in the medical treatment zone, and then advanced to the second end of the continuous rails of the patient support track where the stretcher and patient are rolled onto an aligned second gurney base portion.

30 Claims, 6 Drawing Sheets

EMERGENCY PATIENT SUPPORT AND TRANSPORT SYSTEM

This application claims priority from U.S. Provisional Application Ser. No. 60/721,838 filed on Sep. 29, 2005 to the extent allowed by law.

BACKGROUND

The present invention relates to a non-ambulatory patient support and transport system to be used in emergency response mass casualty situations where numerous patients need to receive medical treatment, such as decontamination to remove chemical, radioactive or biological agents in a short period of time. In mass casualty situations where non-ambulatory patients need to be decontaminated or otherwise treated due to a chemical, radioactive or biohazard occurrence, or other mass casualty affliction, a decontamination station is typically set up to treat the patients. In order to decontaminate numerous patients quickly, hazmat response units have few options. Typically, patients are treated by individual medical staff, which is time consuming and taxing on the staff. Individual treatment of patients often creates long delays in decontamination, increasing the duration that patients are exposed to the hazardous or radioactive materials.

In view of the above, it should be appreciated that there is a need for a patient support and transport system that allows for the rapid decontamination or other medical treatment of ambulatory and non-ambulatory patients without requiring a large quantity of medical staff to assist in the decontamination or treatment of patients. The present invention satisfies these and other needs and provides further related advantages.

SUMMARY

The present invention comprises a patient handling system that is designed to be used in emergency response situations to medically treat patients, particularly those who have been exposed to hazardous biological or radioactive materials. The patient support and transport system is in the form of a rail system that allows a patient and the patient's support bed to be transported to a decontamination or other treatment zone, where decontamination or treatment of the patient and the support bed occurs. The patient support and transport system includes an elevated patient support track formed from individual track sections that are collapsible for ease of transport and storage. The individual track sections are adapted to be interconnected to form a series of continuous support rails. The patient support track is used in combination with a patient gurney having a base portion and a stretcher portion, the latter for supporting the patient. The stretcher portion of the patient gurney is adapted to be releasably secured to the base portion. The base portion of the patient gurney includes a pair of support rails that can be directly connected to either the first or second ends of the continuous rails of the patient support track. The stretcher portion of the patient gurney includes a plurality of rollers and guides that permit the stretcher to roll from the support rails of the patient gurney to the continuous rails of the patient support track. This allows the patient and the stretcher portion to be transported from the base portion of the gurney to the decontamination or treatment zone, and then rolled to the second end of the patient support track where the stretcher portion and patient can be readily rolled onto a second gurney base portion.

Other features and advantages of the invention will be set forth in the description which follows and the accompanying drawings, where the embodiments of the present invention are described and shown, and will become apparent upon examination of the following detailed description taken in conjunction with the accompanying drawings.

BRIEF DESCRIPTION OF THE DRAWINGS

The above-mentioned and other features of the present invention and the manner of obtaining them will become more apparent and the invention itself will be best understood by reference to the following description of elements of the invention taken in conjunction with the accompanying drawings in which.

DETAILED DESCRIPTION OF THE ILLUSTRATED EMBODIMENT

While the present invention will be described fully herein with reference to the accompanying drawings, in which a particular embodiment is shown, it is to be understood that persons skilled in the art may modify the disclosure herein described while still achieving the desired result of this disclosure. Accordingly, the description that follows is to be understood as a broad and informative disclosure directed to persons skilled in the appropriate art and not as limitations on the present invention.

Figure 1:
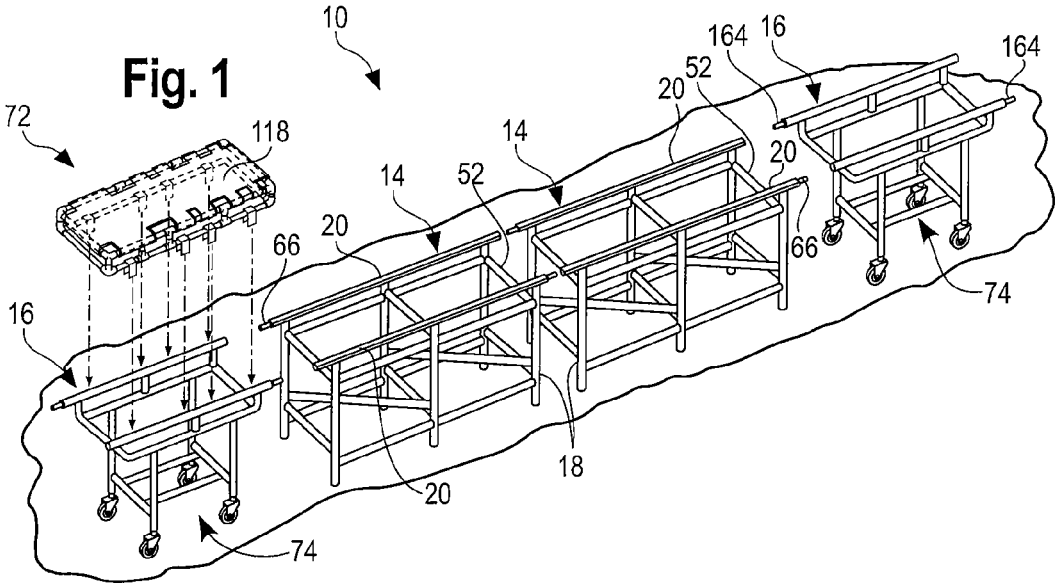
FIG. 1 is a perspective view of the emergency patient support and transport apparatus of the present invention, showing the patient support tracks and patient support gurneys aligned but separated from each other, and with the bed of one patient support gurney shown in an exploded view.
Figure 2:
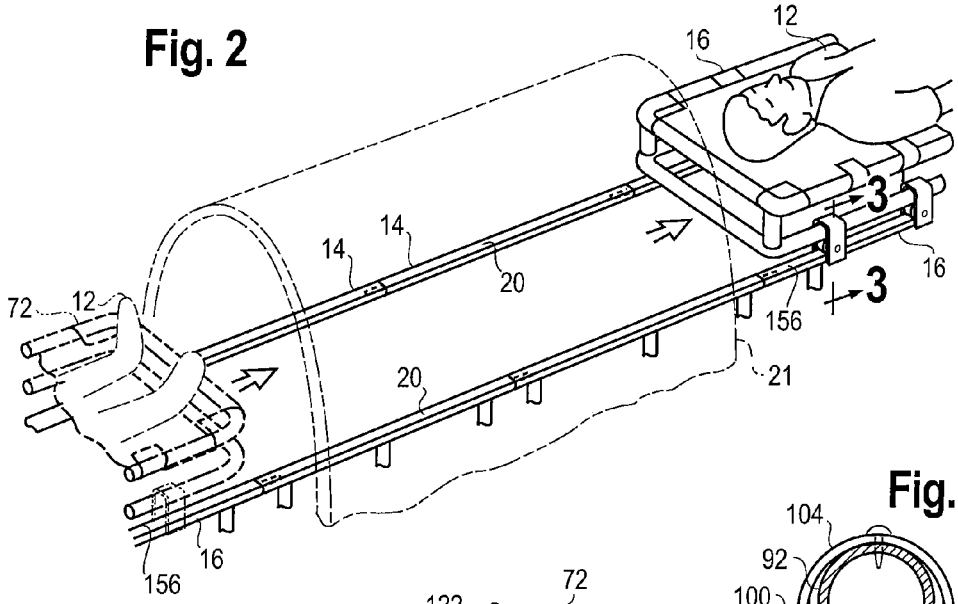
FIG. 2 is a partial perspective schematic view of the patient support tracks and gurney of FIG. 1, showing a patient on the gurney before and after being advanced along the patient support tracks through a medical treatment station.

As illustrated in FIGS. 1 and 2 of the drawings, an emergency patient support and transport apparatus 10 is adapted to move patients 12 to and from a medical treatment station 21, such as patients that have been exposed to either chemical, biological or radioactive contamination. The patient support and transport apparatus 10 is comprised of a plurality of patient support tracks 14 and patient gurneys 16. The patient support and transport apparatus 10 is designed so that each patient gurney 16 can be releasably connected to the patient support track 14 to facilitate the transfer of patients from the gurney 16 to the support track 14 without requiring the patient 12 or the gurney 16 to be elevated, or removing the patient from the upper bed portion 72 of the gurney 16.

Figure 14:
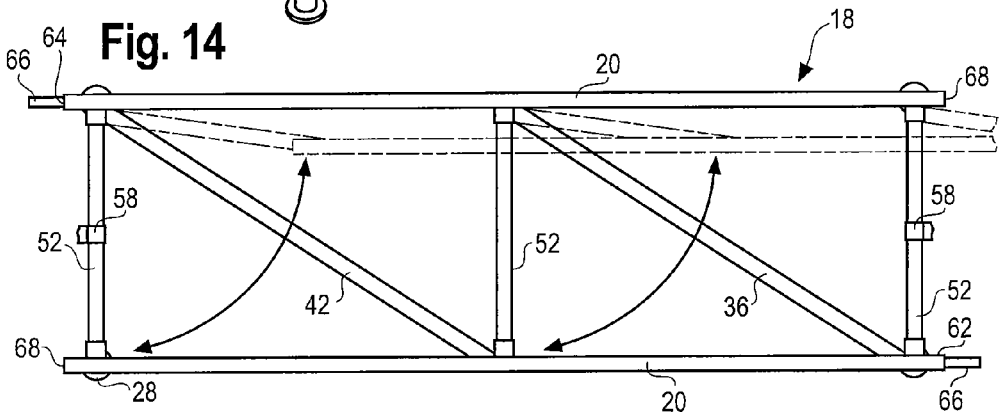
FIG. 14 is a top plan view of the patient support track section of FIG. 13, showing the frame of the track section folded for storage in phantom.

As shown in FIGS. 1, 2 and 14, the patient support and transport apparatus 10 is comprised of a plurality of laterally collapsible track sections 18 that are adapted to be interconnected to form the patient support track 14. The track sections 18 are preferably formed of polymer material such as polyvinylchloride (PVC), but can be formed from other material if preferred, such as other plastics, aluminum or other metals. The track sections 18 include a pair of horizontally spaced parallel support rails 20 that are used to support a portion of the patient gurney 16.

Figure 13:
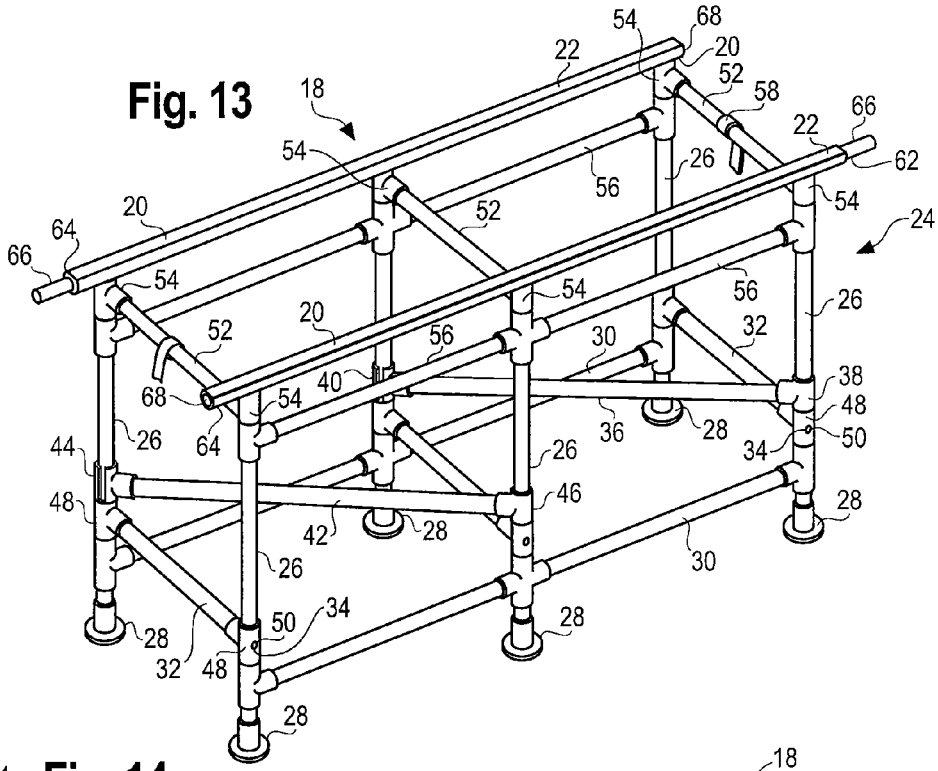
FIG. 13 is a perspective view of a single patient support track section of the present invention.
Figure 15:
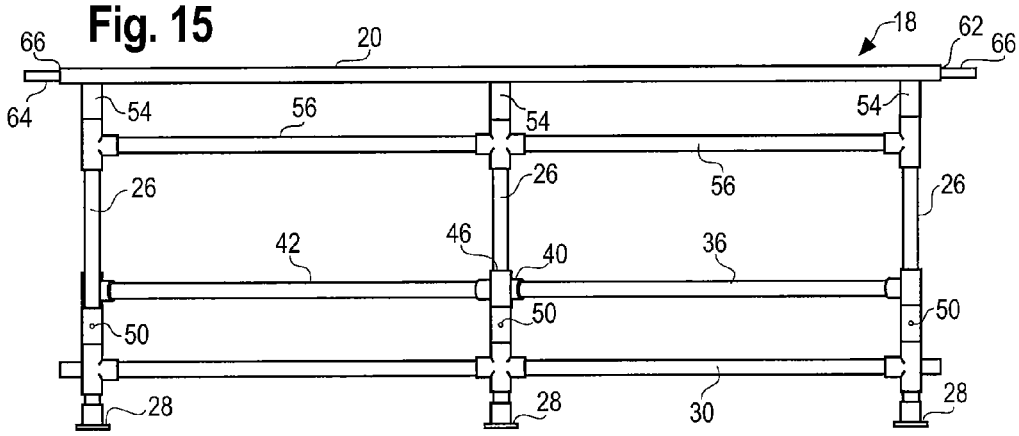
FIG. 15 is a side elevation view of the patient support track section of FIG. 13.

The support rails 20 are preferably generally circular in cross-section and include a planar top surface 22. The planar top surface 22 will be discussed in conjunction with the patient gurney 16 below. Referring to FIGS. 13 to 15, the support rails 20 are connected to a laterally collapsible base structure 24. The base structure 24 of the track sections 18 is comprised of vertical leg members 26, with four of the leg members 26 positioned at the corners of the track section 18. Each leg member 26 includes an adjustable foot 28 to permit adjustment of the elevation of the track section 18 to accommodate uneven ground. The leg members 26 are interconnected along the length of the track sections 18 by use of lower interconnecting members 30. The interconnecting members 30 are rigidly secured at their ends to the leg members 26. The track sections 18 also include a plurality of cross members 32 that are pivotally connected to the leg members 26 at their ends. The cross members 32 permit the track section 18 to fold in a parallelogram type fashion for shipping and storage, as shown in FIG. 14. To secure the track section 18 in an open position, release pins 34 are used to prevent the cross members 32 from pivoting about the leg members 26, as will be explained.

The track sections 18 also include a plurality of locking members 36, that include a pivot coupling 38, at a first end and a clamp coupling 40, secured to a second end, as shown in FIGS. 13 and 14. The pivot coupling 38 of the locking member 36 is adapted to be pivotably connected to one leg member 26 located at one of the corners of the collapsible track sections 18, and the locking member 36 is further adapted to extend diagonally across the center line of the collapsible track sections 18, and frictionally and releasably clamp onto a diagonally opposite leg 26 by use of the clamp coupling 40. Located on the opposite end of the collapsible track section 18 is a second locking member 42 which also includes a pivot coupling 46 and a clamp coupling 44. The second locking member 42 is arranged to be pivotally connected to a leg member 26, diagonally opposite the leg member in which the pivot coupling 38 is connected. The locking member 42 extends diagonally across to a leg member 26 located approximate the mid-point of the base structure 24, and lock member 42 is secured by use of clamp coupling 44. The locking members 36, 42 prevent the base structure 24 of the collapsible track sections 18 from collapsing or folding during use, but when the locking members are disconnected, as seen in FIG. 14, the track sections 18 may be collapsed for ease of storage and shipment.

Further, when in use release pins 34 are adapted to secure the cross members 32 with respect to the leg members 26 to prevent rotation. The cross members 32 include pivot couplings 48 that are pivotally disposed about the leg members 26. The pivot couplings 48 include apertures 50 that correspond with apertures (not shown) in the leg members 26. When the apertures of the leg members 26 are aligned with the apertures 50 of the respective pivot couplings 48, release pins 34 can be installed to rigidly secure the position of the cross members 32 with respect to the leg members 26, preferably at a right angle.

The base structure 24 includes corresponding upper cross members 52 that include pivot couplings 54 pivotably connected near the top of the leg members 26. The base structure 24 also includes longitudinal interconnecting members 56 that are rigidly secured to the leg members 26, as shown in FIG. 13. The cross members 52 located near the ends of the base structure 24 include nylon locking straps 58 to permit securing of plural track sections together, end to end, when in use. While locking straps 58 are shown, other means can be used to secure the collapsible track sections 18 together including clips, bands or fasteners.

The parallel support rails 20 of the collapsible track sections 18 are secured to the base structure 24 by the vertical leg members 26. The parallel support rails 20 are designed to allow the lateral transport of the patient gurney 16 across the rails 20, while the entire structure of track sections 18 is configured to adequately support the weight of a patient and the patient gurney 16. The parallel support rails 20 comprise elongated tubular members that include the planar top surface 22. The support rails 20 may also include an inner tube 60 that is positioned within the support rails 20 to provide added strength.

The support rails 20 include a first end 62 and a laterally spaced apart second end 64, as seen in FIG. 13. The first end 62 of the support rail 20 includes a male connecter 66 of reduced diameter. The second end 64 of the first of the pair of the laterally spaced support rails 20 includes a female connector 68, whereas the adjacent end 66 of support rail 20 includes a male connector 66. The use of the male and female connectors 66, 68 permit the interconnection of the collapsible track sections 18 at the parallel support rails regardless of the direction a track section is facing. Once the ends of adjacent collapsible track sections 18 are connected, locking straps 58 can be secured around adjacent cross members 52 to secure the support rails together (FIG. 13). After the track sections 18 are interconnected, the patient support track is in the assembled position to form a pair of continuous support rails 20. Also, after the collapsible track sections 18 are interconnected, the feet 28 of the leg members 26 can be adjusted to ensure that the continuous support rails 20 are level and secure.

Figure 1A:
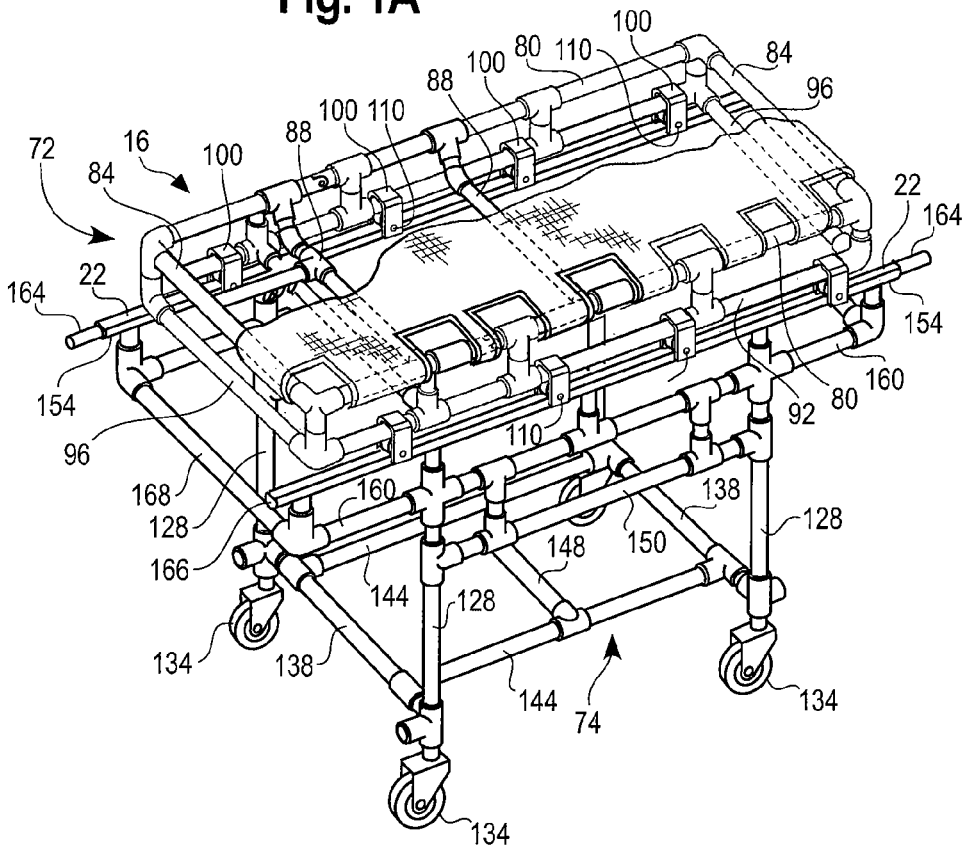
FIG. 1A is a perspective view of the patient support gurney that forms part of the present invention.

The patient support track 14 is adapted to be used in conjunction with the patient gurney 16. The patient gurney 16 is adapted to transport patients from an emergency site to the decontamination area at medical treatment station 21 for connection of the gurney 16 with the support track 14. The patient gurney 16 can also be used to transport patients to a hospital or can be used as temporary bedding in mass casualty situations. Referring to FIGS. 1A, 2, 3 and 6-12, the patient gurney 16 comprises a bed portion 72 for supporting a patient, and a base portion 74 for supporting the bed portion 72, as shown in FIG. 1A. The bed portion 72 is comprised of an upper frame section 76 interconnected to a lower frame section 78. The upper frame section 76 includes a plurality of side members 80 interconnected by a plurality of tee couplers 82. The bed portion 72 also includes a pair of end cross members 84 that are connected to the side members 80 by use of end connectors 86. To provide support in the middle of the bed portion 72, U-shaped cross members 88 are used and are connected to the side members 80 by use of brackets 90.

Figure 3:
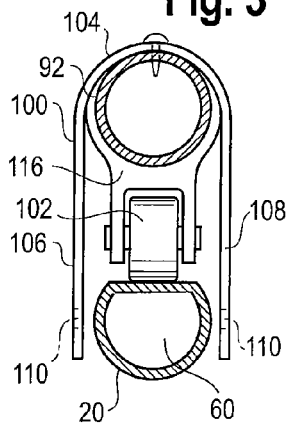
FIG. 3 is a cross-sectional view of the patient support gurney and one of the gurney's rollers and guide assemblies riding on one of the patient support track sections of the present invention.

The lower frame section 78 of the bed portion 72 also includes a plurality of side members 92 that are interconnected by a plurality of tee couplings 94. The tee couplings of the lower frame section 78 are interconnected with the tee couplings 82 of the upper frame section 76 by a plurality of spacers 96. The lower frame section 78 also includes a pair of end cross members 96 that are connected to the side members 92 by use of tee couplings 94. The lower frame section 78 further includes a plurality of center cross members 98 that are connected to the tee couplings 94. Referring to FIG. 3, the side members 92 of the lower frame section 78 include a plurality of roller support bracket assemblies 100, each of which include a roller 102 adapted for traveling along the planar top surface 22 of the base structure 24. The roller support bracket assemblies 100 include a top side 104, an outer extension guide 106 and an inner extension guide 108. The outer and inner guides 106, 108 are adapted to engage the side surfaces of the continuous support rails 20 to prevent derailment. The outer and inner guide extensions 106, 108 include apertures 110 that are adapted to accept release pins 112. The release pins 112 are secured to the roller support brackets 100 by use of a tether 114. Between the outer and inner guides 106, 108 are rollers 102 that are rotatably connected to the side members 92 by use of a roller support bracket 116, as shown in FIG. 3.

Secured to the upper frame section 76 is the patient support surface 118 (FIG. 1). The patient support surface is formed of a nylon mesh material that includes bands 120 that wrap around the side members 80 and cross members 84 of the upper frame section and are secured by a plurality of web straps beneath the bed portion 72. The upper frame section 76 also includes a plurality of patient restraint straps 122 to secure the patient to the patient support surface 118.

Figure 10:
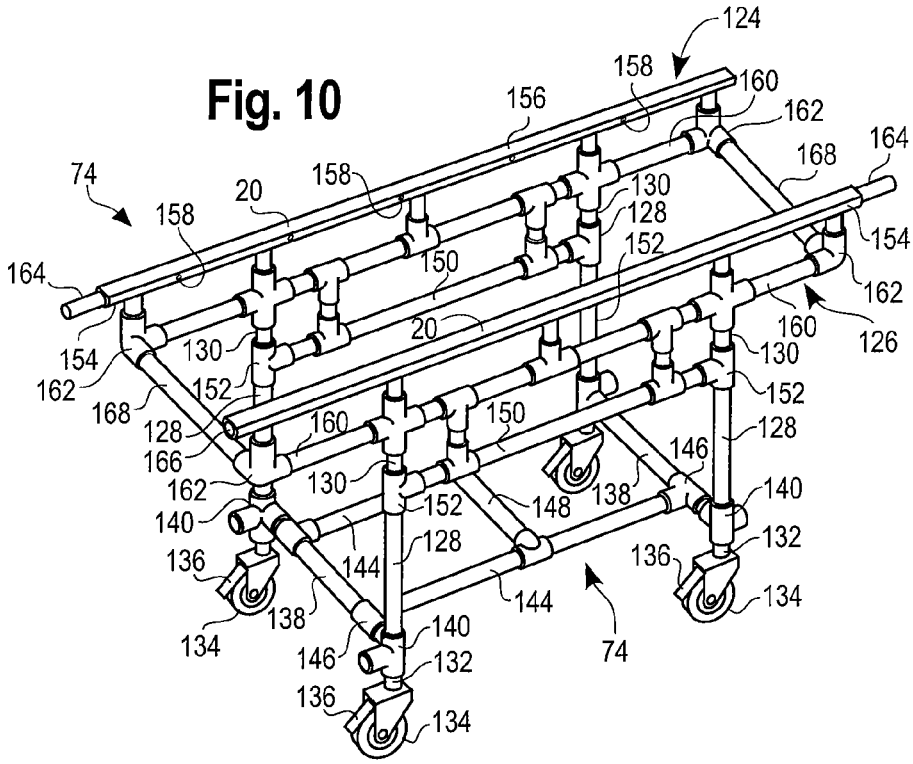
FIG. 10 is a perspective view of the upper and lower frame sections comprising the base portion of the patient support gurney of the present invention.
Figure 11:
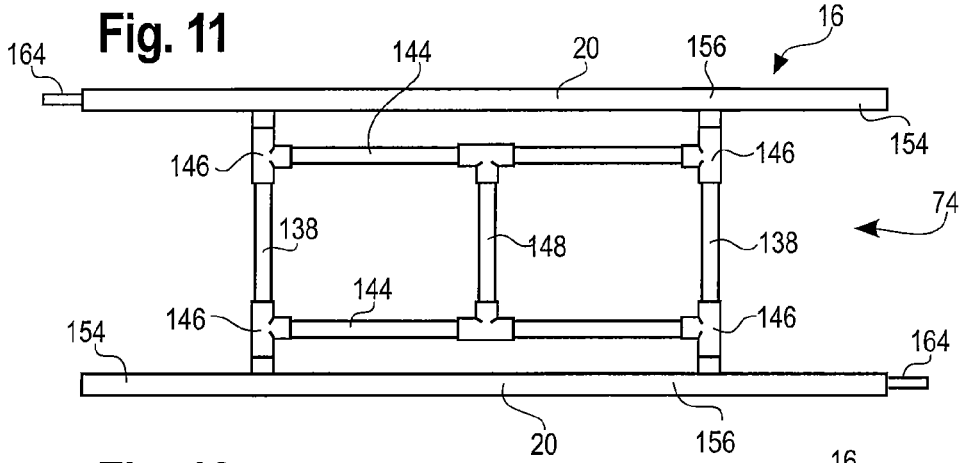
FIG. 11 is a top plan view of the base portion of the patient support gurney of the present invention.
Figure 12:
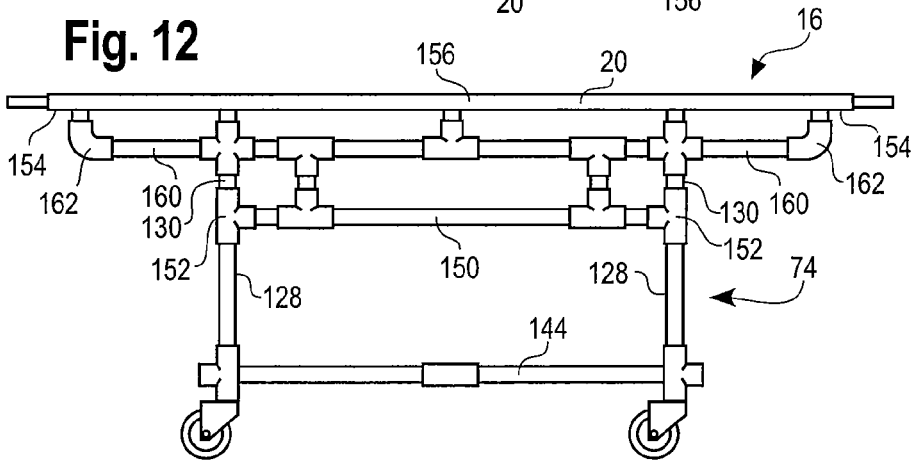
FIG. 12 is a side elevation view of the base portion of the patient support gurney of the present invention.

The base portion 74 of the patient gurney 16, as shown in FIGS. 10-12, is comprised of an upper frame section 124 and a lower frame section 126. The lower frame section 126 is comprised of four vertical leg members 128 that include an upper end 130 and a lower end 132. The lower frame section 126 also includes transport wheels 134 that are pivotably mounted to the lower end 132 of the vertical leg members 128. The transport wheels 134 include locking members 136. The locking members 136 prevent unwanted movement of the base portion 74 of the patient gurney 16. The base portion 74 also includes end cross members 138 that are connected to the leg members 128 by use of tee couplers 140. The base portion 74 of the patient gurney 16 also includes longitudinal members 144 that are connected to end cross members 138 by use of couplings 146. To provide additional support, a center link 148 is used to secure the longitudinal members 144. The lower frame section 126 also includes upper leg support members 150 that are secured to the vertical leg members 128 by use of couplings 152.

The upper frame section 124 includes a pair of longitudinal support rails 154 that are adapted to support the bed portion 72 of the patient gurney 16 when the bed portion 72 is supported atop the gurney 16, as seen in FIGS. 1 and 1A. The support rails 154 have a planar top surface 156 that is designed to permit the rollers 102 of the bed portion 72 to travel along the length of the support rails 154. The support rails 154 include apertures 158 adapted to accept release pins 112 that extend through apertures 110 in outer guides 106 when it is desired to lock bed portion 72 in place on patient gurney 16. The upper frame section 124 also includes longitudinal members 160 that are connected to the support rails 154 by support tees 162. The ends of the support rails 154 include male connectors 164 and female connectors 166. The male and female connectors 164, 166 of the patient gurney 16 are adapted to engage mating portions of the continuous support rails 20 of the patient support track 14. The upper frame section 124 of the base portion 74 also includes a plurality of cross members 168 that are adapted to interconnect and provide rigidity to the longitudinal members 160.

Figure 6:
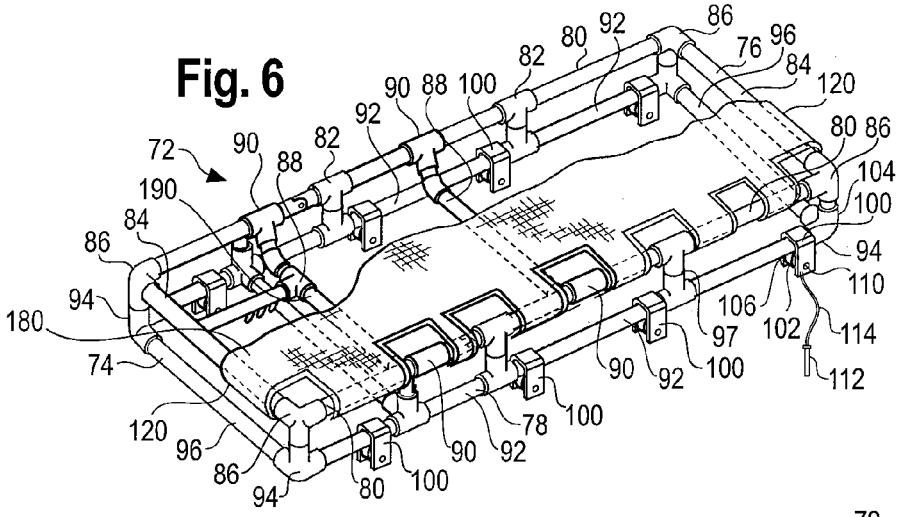
FIG. 6 is a perspective detail view of the bed portion of the patient support gurney shown in FIG. 1A.
Figure 7:
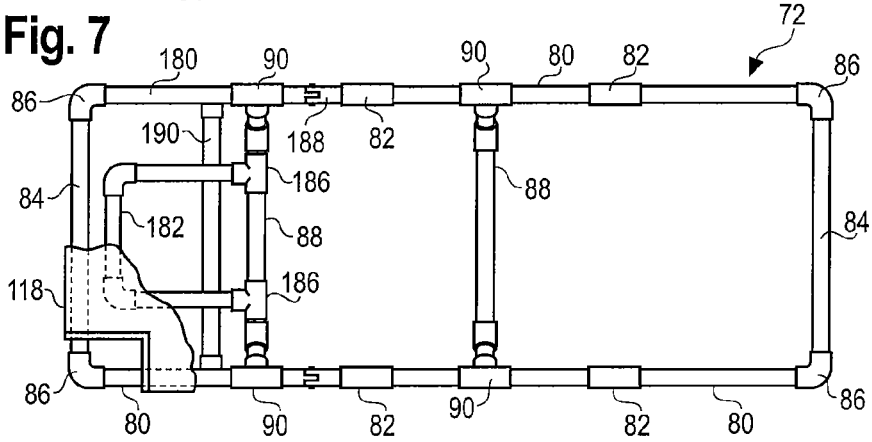
FIG. 7 is a top plan view of the bed portion shown in FIG. 6.
Figure 8:
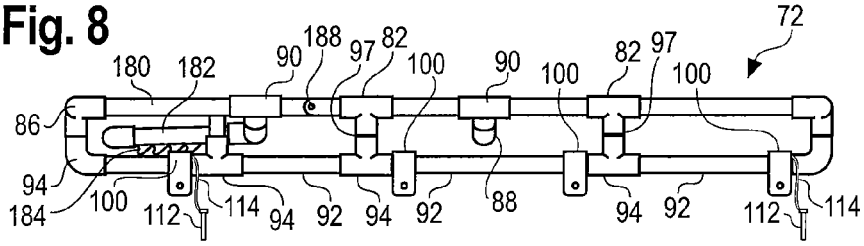
FIG. 8 is a side elevation view of the bed portion shown in FIG. 6.
Figure 9:
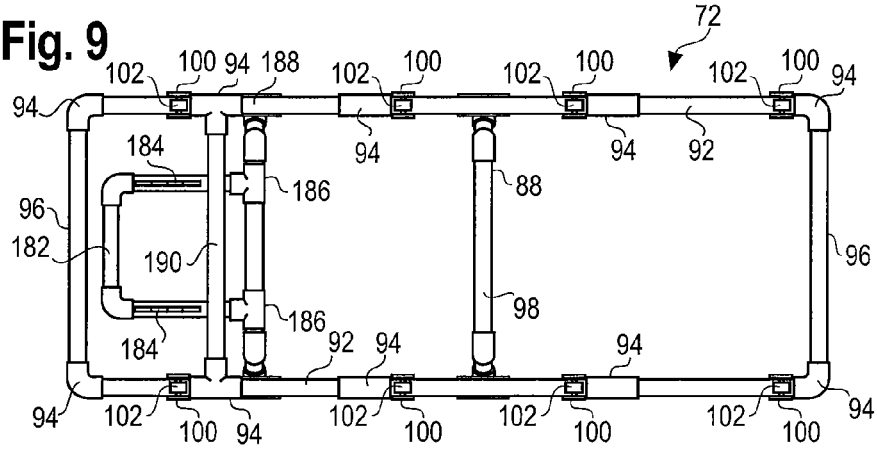
FIG. 9 is a bottom plan view of the bed portion shown in FIG. 6.

In use, the bed portion 72 is positioned on the base portion 74 of the gurney 16 and secured by the release pins 112, as seen in FIG. 6. In this position, the patient 12 can be placed upon the bed portion 72 and transported on the gurney 16 to the patient support track 14. To decontaminate or otherwise provide medical treatment to the patient 12, the patient gurney 16 is aligned with the patient support track 14 so that the connectors 164, 166 are aligned and engage the connectors 66, 68 of the support rail 20 of the patient support track 14 (FIGS. 1, 2). Once the connectors 66, 68, 164, 166 are engaged, locking strap 58 is secured to the cross members 168 of the base portion 74 of the patient gurney 16. Having secured the patient gurney 16 to the patient support track 14, release pins 112 are removed from apertures 158, permitting the bed portion 72 of the gurney 16 to roll from the support rails 154 to the support rails 20 of the patient support track 14. The patient can then be transported along the rails 20 to a decontamination or medical treatment zone or station where the patient is washed and/or treated without requiring removal of the patient from the bed portion 72.

At the opposite end of the continuous support rail 20, medical personnel can connect the base portion 74 of a second patient gurney 16 and secure the base portion 74 with the locking strap 58. Once the patient is decontaminated, the patient 12 and bed portions 72 can be transported along the continuous support rail 20 and onto a second patient gurney 16 where release pins 112 are re-installed in apertures 158 to secure the bed portion 72 to the base portion 74 of the second patient gurney 16.

When the patient track 20 is no longer needed, locking straps 58 are disconnected from adjacent track sections 18 by removing the locking straps 58 from the cross members 52. Once the collapsible track sections 18 are disconnected, locking pins 34 can be removed and locking members 36 can be disconnected from the vertical leg members 26 to allow the track sections 18 to be folded to permit ease of storage.

Figure 4:
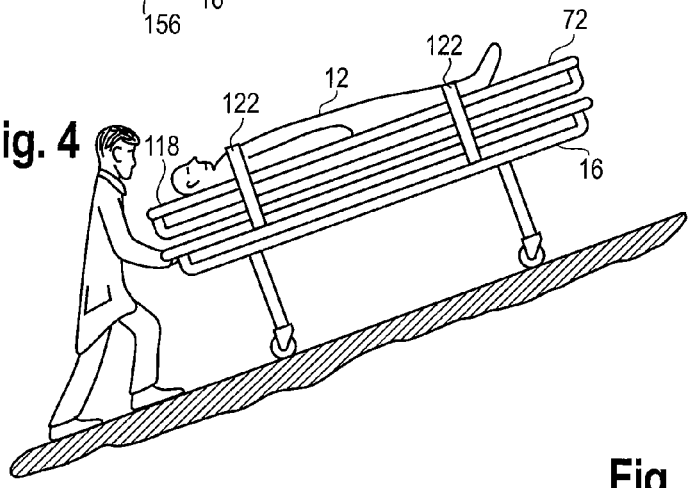
FIG. 4 is an elevation view of the patient support gurney portion of the present invention, shown conveying a patient up an inclined surface.
Figure 5:
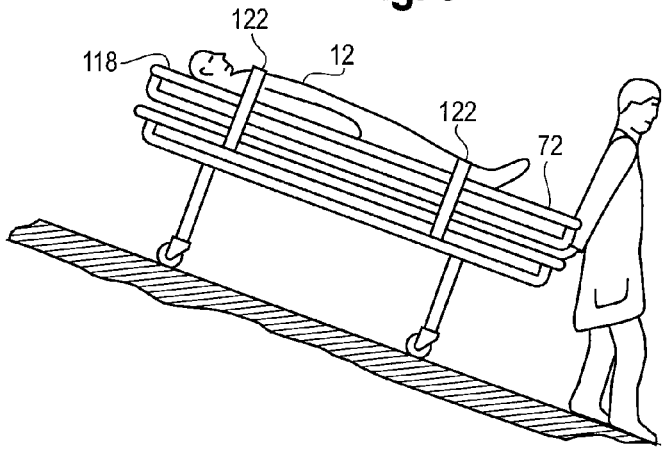
FIG. 5 is an elevation view of the patient support gurney portion of the present invention, shown conveying a patient down an inclined surface.
Figure 16:
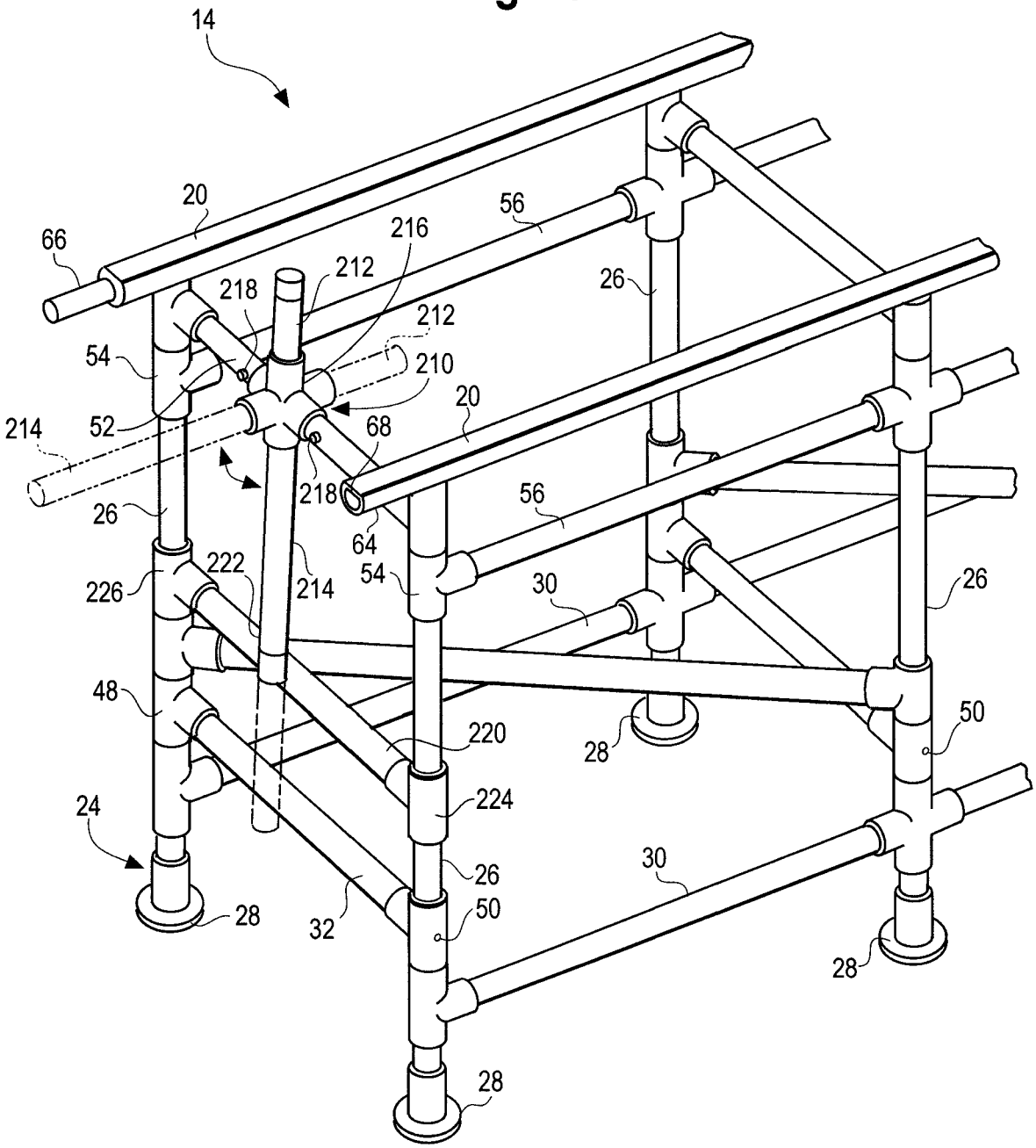
FIG. 16 is a perspective view of an embodiment of one patient support track section of the present invention, incorporating a pivotal stop mechanism at one end of a patient support track section.

A further embodiment of the present invention is illustrated in FIG. 16. In certain instances, it may be necessary to install the patient transport and support apparatus 10 on an inclined or sloped surface, as seen in FIGS. 4 and 5. In such situations, when the bed portion 72 (FIG. 1A) is rolled onto support rails 20 of patient support track 14, gravity forces will prevent the rolling bed portion from reaching a stabilized position on the rails 20 at a given treatment station 21, such as a decontamination station. The embodiment shown in FIG. 16 includes a pivotal stop mechanism 210 that allows the bed portion 72, with the patient 12, to advance in one direction from the base portion 74 of gurney 16 onto rails 20 of the patient support track 14, but prevents the bed portion 72 from rolling off of the rails 20.

If the patient transport and support apparatus 10 is placed on an upwardly inclining surface (from the standpoint of the gurney 16 and patient 12), the patient support track 14 will be positioned as shown in FIG. 16, with the bed portion 72 being rolled onto tracks 20 from right to left. If the patient transport and support apparatus 10 is placed on a downwardly sloping surface, the position of patient track support 14 is rotated horizontally 180 degrees, placing the pivotal stop mechanism 210 at a far end of the patient support track 14.

Pivotal stop mechanism 210 (FIG. 16) comprises an upper stop member 212 and a lower engaging member 214 connected in alignment with each other through a pivoting joint coupler 216. Joint coupler 216 is rotatably mounted on cross member 52 at one end of patient support track 14. Lateral movement of joint coupler 216 along the axis of cross member 52 is restricted by pins, screws, bolts or other suitable protrusions 218 extending outward from the surface of cross member 52.

In the embodiment illustrated in FIG. 16, an additional cross member 220 (compared to the embodiment illustrated in FIG. 13) extends between opposing vertical leg members 26, and is rigidly fixed to leg members 26 by a pair of opposed tee couplers 224, 226. The length of lower engaging member 214 is predetermined such that as pivotal stop mechanism 210 rotates counter clockwise (as illustrated in FIG. 16), end 222 of lower engaging member 214 engages cross member 220, thus halting further rotation of pivotal stop mechanism 210, and of upper stop member 212. In a further embodiment of the invention shown in FIG. 16, the additional cross member 220 may be eliminated, and the length of lower engaging member is predetermined to engage lower cross member 32.

The embodiment of the invention shown in FIG. 16 operates as follows: When bed portion 72 with the patient 12 (FIG. 2) is rolled off of rails 154 of gurney 16, and onto rails 20 of patient support track 14, as described above, leading end cross member 96 (FIG. 6) of bed portion 72 contacts upper stop member 212, causing pivotal stop mechanism 210, and lower engaging member 214, to rotate counterclockwise, as viewed in FIG. 16, to a rear horizontal position of stop mechanism 210, thus allowing bed portion 72 to pass unrestricted onto rails 20. As each sequential center cross member 98, and trailing end cross member 96 contacts upper stop member 212, the pivotal stop mechanism 210 pivots out of the way, allowing the bed portion 72 to be smoothly transferred to tracks 20 of patient support track 14, whereby gurney 16 is rolled away from the treatment station. After the rear end cross member 96 of bed portion 72 advances past upper stop member 212, the pivotal stop mechanism 210 rotates clockwise back to a somewhat vertical position due to the fact that lower engaging member 214 is longer and heavier than upper stop member 212.

If the patient transport and support apparatus 10 is on an upwardly inclined slope, the bed portion 72 will have a tendency to roll backwards along rails 20, and possibly off of rails 20. However, as the rear end cross member 96 of bed portion 72 contacts upper stop member 212, with patient support track 14 in the position shown in FIG. 16, pivotal stop mechanism 210 rotates clockwise through a relatively short arc until lower engaging member 214 engages additional cross member 220 (or cross member 32), thereby preventing further rotation of pivotal stop mechanism 210. Rear end cross member 96 of bed portion 72 bears against upper stop member 212, preventing bed portion 72 from rolling backward and holding bed portion 72 in place at the treatment station.

If the patient transport and support apparatus 10 is placed on a downwardly inclined slope, the position of patient support track 14 is rotated horizontally from the position shown in FIG. 16, such that the pivotal stop mechanism 210 is located on the trailing or downhill end of support track 14. As bed portion 72 is rolled off base portion 74 of gurney 16, bed portion 72 will advance across rails 20 until the forward or lead cross member 96 of bed portion 72 contacts upper stop member 212 of stop mechanism 210. The rotative movement of stop mechanism 210 about cross member 52 will be halted when lower engaging member 214 engages additional cross member 220, or engages cross member 32 if additional cross member 220 is eliminated. Bed portion 72 will come to a stop as forward cross member 96 bears against stationary upper stop member 212.

When it is desired to advance bed portion 72 off of rails 20 of patient support track 14, bed portion 72 is manually moved a short distance back along rails 20 until the top end of upper stop member 212 clears the cross members of bed portion 72. The pivotal stop mechanism 210 is then held in a somewhat horizontal position until the bed portion 72 is advanced off of rails 20 of patient support track 14, as previously described.

Various features of the disclosure have been shown and described in connection with the illustrated embodiment, however, it is understood that these arrangements merely illustrate, and that the disclosure is to be given its fullest interpretation.

What is claimed is:

1. A patient support and transport system for advancing the patient into a medical treatment facility, said patient support and transport system comprising:

a patient gurney having a base portion and a bed portion adapted to support the patient, said bed portion releasably secured to said base portion;

a patient support track apparatus having first and second ends, each of said ends adapted to releasably engage said base portion of said patient gurney, said patient support track apparatus having a treatment zone positioned between said first and said second ends;

said patient support track apparatus further including a bed support surface for supporting said bed portion of said patient gurney, said bed support surface permitting said bed portion to travel laterally along said bed support surface from said first end, to and from said treatment zone, to said second end of said patient support track apparatus;

wherein when said patient gurney is releasably secured to said patient support track apparatus, said bed portion of said patient gurney is laterally transportable from said base portion of said gurney to said bed support surface without requiring a change in elevation of said bed portion of said patient gurney.

2. The patient support and transport system of claim 1, wherein said base portion of said patient gurney includes a pair of rails that support said bed portion in either a static or moving position of the bed portion.

3. The patient support and transport system of claim 2, wherein said bed support surface of said patient support track apparatus includes a pair of rails that are adapted to support said bed portion of said patient gurney.

4. The patient support and transport system of claim 3, wherein said bed portion includes a plurality of rollers adapted to glide along said rails of said base portion and along the rails of said bed support surface of said patient support track apparatus.

5. The patient support and transport system of claim 3, wherein said rails of said base portion of said gurney are adapted to engage and align with said rails of said bed support surface of said patient support track apparatus and form a continuous rail system.

6. The patient support and transport system of claim 5, wherein the top surface of the rails of said base portion of said gurney and said rails of said bed support surface of said patient support track apparatus are planar.

7. The patient support and transport system of claim 1, wherein said bed portion includes a plurality of rollers adapted to glide along said bed support surface of said patient support track apparatus.

8. The patient support and transport system of claim 1, wherein said patient support track apparatus is comprised of a plurality of laterally collapsible support sections, each of said support sections supporting rail sections.

9. The patient support and transport system of claim 8, wherein the ends of said rail sections of said laterally collapsible support sections are adapted to be releasably interconnected and form a continuous rail system.

10. The patient support and transport system of claim 1, wherein said bed portion of said gurney includes guides adapted to extend adjacent a portion of said patient support track apparatus to prevent said bed portion from separating from said bed support surface while transporting the bed portion over said patient support track apparatus.

11. The patient support and transport system of claim 1, wherein said patient support track apparatus comprises a pivotal stop mechanism at one of said first and second ends, said pivotal stop mechanism moveable to a first position to allow said bed portion to advance laterally along said bed support surface to said treatment zone, said pivotal stop mechanism moveable to a second position preventing movement of said bed portion along said bed surface as said bed portion engages said pivotal stop mechanism.

12. The patient support and transport system of claim 11, wherein said pivotal stop mechanism comprises a stop member extending in a first position prior to contact with said bed portion when said bed portion is advanced from said patient gurney onto said bed surface, said bed portion moving said first stop member to a second position as said bed portion is advanced over said bed surface.

13. The patient support and transport system of claim 12 wherein said first stop member returns to said first position after said bed portion has reached said treatment zone of said patient support track apparatus.

14. The patient support and transport system of claim 12 wherein said pivotal stop mechanism includes an engaging member, said engaging member engaging a rigid portion of said patient support track apparatus when said stop member is in said first position.

15. The patient support and transport system of claim 14 wherein said stop member prevents movement of said bed portion when said bed portion bears against said stop member.

16. A patient support and transport apparatus for use in decontaminating or otherwise providing medical treatment to patients, said patient support and transport apparatus comprising:

a transportable patient stretcher adapted to support a non-ambulatory patient, said patient stretcher having a plurality of rotatable rollers;

a patient support track adapted to support said patient stretcher, said patient support track formed of individual track sections, each of said track sections having support rails;

said support rails of said track sections adapted to be interconnected to form a continuous rail surface, said track sections having a first end, a second end and a medical treatment zone positioned between said first and second ends;

said patient stretcher adapted to be positioned on said patient support track with said rollers positioned against said continuous rail surface, said patient stretcher capable of traveling across said continuous rail surface from said first end to said second end of said track sections.

17. The patient support and transport apparatus of claim 16, wherein said individual track sections are foldable.

18. The patient support and transport apparatus of claim 16, wherein the height of said individual track sections is adjustable to permit an increase or decrease in elevation of said track sections when the track sections are placed on an uneven surface.

19. The patient support and transport apparatus of claim 16, wherein said rollers are mounted in brackets having downwardly extending guide members preventing said patient stretcher and said rollers from derailing from said continuous rail surface.

20. The patient support and transport apparatus of claim 16, wherein said support rail surfaces of said track sections include male and female ends to permit interconnection of said individual track sections.

21. The patient support and transport apparatus of claim 20, wherein said male and female ends are interconnected by use of releasable fasteners.

22. The patient support and transport apparatus of claim 16, wherein the top surface of said continuous rail surfaces are planar.

23. The patient support and transport apparatus of claim 16, further including a wheeled base portion having rails adapted to support said patient stretcher.

24. The patient support and transport apparatus of claim 23, wherein said rails of said wheeled base portion are adapted to be connected with said continuous rail surfaces of said patient support track, enabling said patient stretcher to be rolled from said wheeled base portion directly onto said continuous rail surfaces of said individual track sections without the need to elevate said patient stretcher.

25. A patient transport apparatus for transporting patients from a first location to a second location, said patient transport apparatus comprising:

a patient gurney having a base portion and a stretcher portion adapted to support the patient, said stretcher portion releasably secured to said base portion;

a patient support track adapted to support said stretcher portion, said patient support track formed of individual track sections, each of said track sections having a base portion and at least two support rails, each of said track sections movable between a first use position and a second storage position;

said at least two support rails of said track sections adapted to be interconnected to form at least two continuous rail surfaces having a first end and a second end;

said base portion of said patient gurney having a pair of support rail surfaces, that can be connected to either said first or second end of said at least two continuous rail surfaces of said track sections, said stretcher portion having means for transporting said stretcher portion to said at least two continuous rail surfaces, enabling said stretcher portion to travel across said continuous rail surfaces from said first end to said second end.

26. The patient transport apparatus of claim 25, wherein said individual track sections are foldable.

27. The patient transport apparatus of claim 25, wherein the height of said individual track sections are adjustable to permit an increase or decrease in elevation of said track sections when placed on an uneven surface.

28. The patient transport apparatus of claim 25, wherein said means for transporting includes a set of rollers rotatably attached to said stretcher portion to permit said stretcher portion to roll from said support rail surfaces of said gurney base portion onto said at least two continuous rail surfaces of said patient support track.

29. The patient transport apparatus of claim 25, wherein said support rails of said track sections include male and female ends to permit interconnection of the patient gurney with the patient support track.

30. The patient transport apparatus of claim 29, wherein said male and female ends are interconnected by use of releasable fasteners.

* * * * *